US008009851B2

(12) United States Patent
De Pooter et al.

(10) Patent No.: US 8,009,851 B2
(45) Date of Patent: Aug. 30, 2011

(54) NOISE REDUCTION SYSTEM AND METHOD

(75) Inventors: Pieter De Pooter, Emmen (NL); Gerrit Johannes Willem Sampimon, Emmen (NL); Johannes Lucas Schreuder, Ees (NL); Rudy Stubenitsky, Emmen (NL)

(73) Assignee: Sony Ericsson Mobile Communications, Lund (SE)

( * ) Notice: Subject to any disclaimer, the term of this patent is extended or adjusted under 35 U.S.C. 154(b) by 1316 days.

(21) Appl. No.: 11/562,707

(22) Filed: Nov. 22, 2006

(65) Prior Publication Data

US 2008/0118096 A1 May 22, 2008

(51) Int. Cl.
*H04R 9/08* (2006.01)
*H04R 11/04* (2006.01)

(52) U.S. Cl. ..... 381/359; 381/355

(58) Field of Classification Search ..... 381/355, 381/357, 359, 361, 364, 365
See application file for complete search history.

(56) References Cited

U.S. PATENT DOCUMENTS

| | | | | |
|---|---|---|---|---|
| 2,536,261 | A | 1/1951 | Caldwell, Jr. | |
| 4,966,252 | A | 10/1990 | Drever | |
| 5,442,713 | A | 8/1995 | Patel et al. | |
| 2003/0194103 | A1 * | 10/2003 | Kakinuma | 381/361 |

FOREIGN PATENT DOCUMENTS

| | | | |
|---|---|---|---|
| WO | WO2005/067653 | A2 | 7/2005 |
| WO | WO 2005/067653 | A2 | 7/2005 |

* cited by examiner

*Primary Examiner* — Brian Ensey
(74) *Attorney, Agent, or Firm* — Harrity & Harrity, LLP

(57) ABSTRACT

The present invention relates to a sound receiving device and a microphone unit for such a sound receiving device. In microphone unit there is provided a microphone, an air filled chamber and a wind noise barrier covering chamber for providing a wind shield and having at least one air passage channel connecting the exterior of the device with the air filled chamber and having an inlet facing the exterior of the device and an outlet facing the air filled chamber. The air passage channel comprises at least one turn for reducing the influence of the wind on microphone. The invention provides enhanced wind noise reduction.

25 Claims, 6 Drawing Sheets

NOISE REDUCTION SYSTEM AND METHOD

TECHNICAL FIELD OF THE INVENTION

The present invention generally relates to the field of receiving of sound, using microphones and, more particularly to a sound receiving device and a microphone unit for such a sound receiving device.

BACKGROUND ART

Microphones used for portable electronic devices may be "directional" or "omni-directional." Such devices (e.g., cellular telephones) may, at times, be used in circumstances in which the microphone is subject to transient (e.g., "popping" of a spoken "p" phoneme) or sustained (e.g., wind) airflow disturbance. In certain conditions, airflow incident upon the microphone may be so substantial as to be picked up by the microphone and produce an undesirable noise signal that interferes with the microphone's use. During a phone call, for instance, audible airflow noise may make sound transmissions difficult to hear on the part of a listener.

Typically, several types of omni-directional microphones have been used in portable electronic communication devices, such as cellular phones or cell phone accessories. Although omni-directional microphones are considered to be less sensitive to wind-noise from air blowing into microphone compared to directional microphones, wind-noise often remains problematic. Thus, noise-cancelling algorithms are sometimes used to combat the problem and improve acoustical performance. However, such electronic solutions requiring power consumption are not always suitable in portable devices powered by limited battery capacity. Furthermore, it is often the case that the device in which wind-noise is to be reduced has no power supply at all.

Windscreen barriers are of particular interest for use in directional microphones. The benefit of directional microphones is that the sound picked up may be of better quality, while a limitation is that directional microphones are much more sensitive to wind-noise than omni-directional microphones.

The use of wind-noise barriers in directional microphones has been investigated. Windscreen barriers are typically provided in the form of porous membranes. Examples of such barriers are, for instance, described in U.S. Pat. Nos. 4,966,252; 5,442,713; and 2,536,261.

Such barriers are likely to be of interest for being provided in accessories, like portable hands-free devices in relation to cellular phones, for instance, in headsets, and the like. One such headset with a windscreen barrier is described in WO 2005/067653, in which a microphone is placed in an air-filled chamber surrounded by a windscreen barrier made of a mesh material.

The above-described barriers attempt to provide some degree of wind-noise reduction. However, the barriers have limited noise reduction effectiveness with respect to design (e.g., size, dimensions, etc.) limitations and/or compromised sound reception/transmission quality.

SUMMARY OF THE INVENTION

Implementations of the present invention provide superior wind-noise reduction.

Accordingly, implementations of the present invention may provide a microphone unit that exhibits a measurable reduction in the effect of wind noise.

According to a first aspect of the invention, a microphone unit for a portable sound receiving device, comprising a microphone; an air filled chamber; and a wind noise barrier covering chamber for providing a wind shield and having at least one air passage channel connecting the exterior of the device with the air filled chamber and having at least one inlet facing the exterior of the device and at least one outlet facing the air filled chamber, wherein said channel comprises at least one turn for reducing the influence of the wind on microphone.

A second aspect of the present invention is directed to a microphone unit including the features of the first aspect, wherein the walls of each channel are made of an airtight material.

A third aspect of the present invention is directed to a microphone unit including the features of the first aspect, wherein each channel is filled with a porous wind reduction material.

A fourth aspect of the present invention is directed to a microphone unit including the features of the first aspect, wherein barrier has an outer surface facing the exterior, an inner surface facing chamber, a first end attached to one end of chamber and a second end provided at a second opposite end of chamber.

A fifth aspect of the present invention is directed to a microphone unit including the features of the fourth aspect, wherein channel stretches within barrier essentially aligned with the inner and outer surfaces of barrier.

A sixth aspect of the present invention is directed to a microphone unit including the features of the fourth aspect, wherein there is only one channel.

A seventh aspect of the present invention is directed to a microphone unit including the features of the sixth aspect, wherein the inlet is provided at the first end of barrier and the outlet is provided at the second end of barrier.

An eighth aspect of the present invention is directed to a microphone unit including the aspects of the sixth aspect, wherein chamber has a bottom surface and there is a rotational-symmetrical axis of chamber provided through the bottom surface and the center of chamber that is perpendicular to the bottom surface, where channel is provided symmetrically around said rotational-symmetrical axis A ninth aspect of the present invention is directed to a microphone unit including the features of the eight aspect, wherein the inlet is coaxial with the axis and the outlet is distanced from and provided symmetrically around the axis.

A tenth aspect of the present invention is directed to a microphone unit including the features of the eighth aspect, wherein the inlet is distanced from and provided symmetrically around the axis and the outlet is coaxial with the axis.

An eleventh aspect of the present invention is directed to a microphone unit including the features of the fourth aspect, wherein there are several channels provided in barrier.

A twelfth aspect of the present invention is directed to a microphone unit including the features of the eleventh aspect, wherein the inlet of each channel provided at the outer surface of barrier is aligned with the corresponding outlet on the inner surface of barrier.

A thirteenth aspect of the present invention is directed to a microphone unit including the features of the eleventh aspect, wherein chamber has a bottom surface and there is a rotational-symmetry axis provided through the bottom surface and the center of chamber that is perpendicular to the bottom surface and channels are provided symmetrically around the axis.

A fourteenth aspect of the present invention is directed to a microphone unit including the features of the first aspect, wherein microphone is provided in the air filled chamber.

A fifteenth aspect of the present invention is directed to a microphone unit including the features of the fourteenth aspect, wherein chamber has a bottom surface, there is an axis provided through the bottom surface and the center of chamber that is perpendicular to the bottom surface and where barrier provides all walls and ceilings of chamber, wherein microphone is angled away from this axis.

A sixteenth aspect of the present invention is directed to a microphone unit including the features of the fifteenth aspect, wherein microphone is directional.

A seventeenth aspect of the present invention is directed to a microphone unit including the features of the fifteenth aspect, wherein microphone is angled by about forty-five degrees to said axis.

An eighteen aspect of the present invention is directed to a microphone unit including the features of the fifteenth aspect, wherein microphone is angled by about ninety degrees to said axis.

A nineteenth aspect of the present invention is directed to a microphone unit including the features of the first aspect, wherein microphone is in contact with the air filled chamber via a sound channel.

A twentieth aspect of the present invention is directed to a microphone unit including the features of the first aspect, wherein there is an additional chamber providing an additional air volume beneath the air-filled chamber, being in contact with the air-filled chamber via a passage in the form of a vent.

Some implementations of the present invention provide a portable sound receiving device that exhibits measurable reduction in the effect of wind noise.

According to a twenty-first aspect of the present invention, a portable sound receiving device comprises: a microphone unit having a microphone; an air filled chamber; and a wind noise barrier covering chamber for providing a wind shield and having at least one air passage channel connecting the exterior of the device with the air filled chamber and having at least one inlet facing the exterior and at least one outlet facing the air filled chamber, wherein said channel comprises at least one turn for reducing the influence of the wind on microphone.

A twenty-second aspect of the present invention is directed to a portable sound receiving device including the features of the twenty-first aspect wherein the device is a portable communication device.

A twenty-third aspect of the present invention is directed to a portable sound receiving device including the features of the twenty-second aspect, wherein the portable communication device is an accessory to another portable communication device.

A twenty-fourth aspect of the present invention is directed to a portable sound receiving device including the features of the twenty-third aspect, wherein it is a hands-free unit.

The present invention is furthermore directed to a microphone unit and portable sound receiving device including such a microphone unit, where microphone unit comprises: a microphone; an air filled chamber; a wind noise barrier covering chamber for providing a wind shield, and a sound channel connecting microphone with the air filled chamber.

In some implementations, the microphone unit may be equipped with an additional chamber providing an additional air volume beneath the air-filled chamber, being in contact with the air-filled chamber via a passage in the form of a vent.

The present invention has a number of advantages. For example, it allows enhanced wind noise reduction through changing the wind noise direction and enhancing the air resistance. It is furthermore reduced in size as compared with a conventional microphone unit that provides the same amount of wind noise reduction. The invention is also inexpensive to produce.

These and other objects and advantages of the invention will be apparent from the following description taken in conjunction with the accompanying drawings.

BRIEF DESCRIPTION OF THE DRAWINGS

The accompanying drawings, which are incorporated in and constitute a part of the specification, illustrate an implementation of the invention and, together with the description, explain the invention. In the drawings.

DETAILED DESCRIPTION OF THE PRESENT INVENTION

Embodiments of the present invention may be implemented in all types of microphones to reduce sensitivity to wind-noise, e.g., in both directional and omni-directional microphones.

Figure 1:
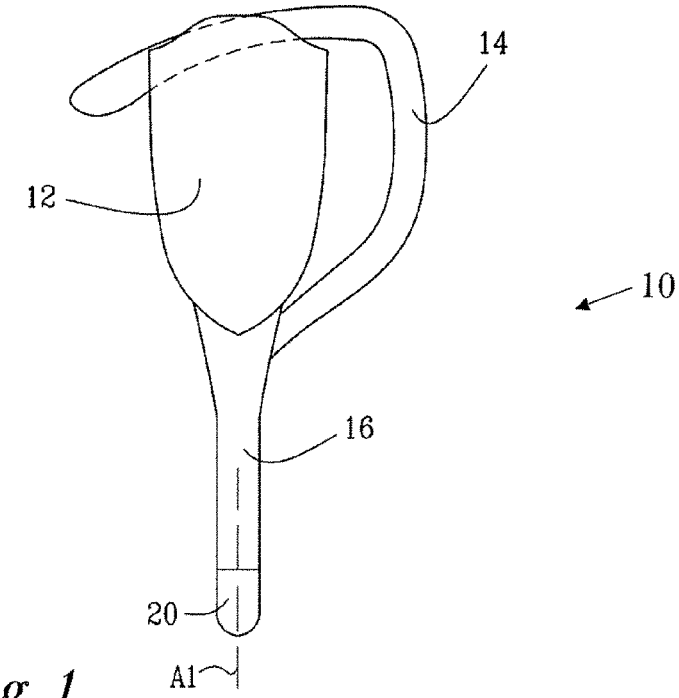
FIG. 1 shows a front view of an accessory according to the present invention in the form of a portable sound recording device, which as an example is provided in the form of a headset.

In FIG. 1, a sound recording device according to one implementation of the present invention is shown in the form of a headset 10 which may include an ear piece 12 adapted to be proximate to the ear of a user, a first arm 14 that may be formed to be worn around the user's ear, and a second arm 16. Second arm 16 may include a rounded distal end as well as an ear piece facing end adjoining ear piece 12. A longitudinal axis Al is shown as going through a middle of second arm 16 along a length thereof in a direction from the ear piece facing end towards and through the rounded distal end. At the rounded distal end, a microphone unit 20 may be disposed.

In use, headset 10 may be configured to fit the head of the user and provide sounds to the user's ear (via ear piece 12) and receive sound from the user via microphone unit 20. The received sounds may here be sent from headset 10 to a portable communication device, for instance, a cellular phone. A headset is just one example of an accessory in which the present invention is provided. The invention is not limited to these, but can be applied to any type of accessory or portable sound recording device, where sound is to be picked up and/or recorded via a microphone.

Figure 2:
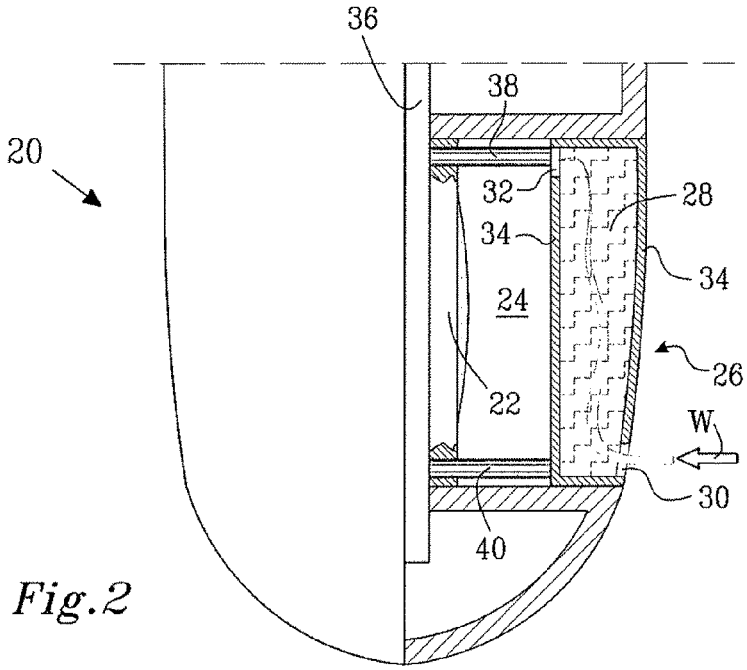
FIG. 2 shows a side view of a microphone unit provided in the headset of FIG. 1 according to a first embodiment of the present invention.

FIG. 2 shows a side view of microphone unit 20 according to an exemplary first embodiment according to the present invention. Microphone unit 20 may include a microphone 22 that may mount to a printed circuit board 36 (PCB) of the device provided in second arm 16. Microphone 22 may include a gas (e.g., air) filled space, such as a compartment or chamber 24 that may be defined by or include two opposing walls provided on opposite sides of microphone 22. A first wall may be provided close to the rounded distal end of second arm 16 provided substantially perpendicular to the longitudinal axis of second arm 16 and a second wall may be provided substantially in parallel or coplanar with the first wall and distanced from the first wall in a direction toward the ear piece end. One or both of the walls may extend out from circuit board 36 toward an outer surface of second arm 16. Chamber 24 may be at least partially covered, so as to be, for example, surrounded or enclosed by a barrier 26 that acts as a wind screen. Barrier 26 may be attached to circuit board 36 via, for example, two studs 38 and 40.

Barrier 26 may, in a first embodiment, be provided with an outer surface facing outwards to an area that is external of headset 10 and that is adapted in shape or conforms to, for example, the surrounding casing of second arm 16 so as to provide a substantially uniform exterior of headset 10. Barrier 26 may have an inner surface that is essentially parallel or coplanar with the outer surface and face chamber 24. Barrier 26 may have a first end provided at the first wall and a second end provided at the second wall. Barrier 26 may include an air passage channel 28 that may connect an exterior of headset 10 with chamber 24, i.e., be interposed between the exterior and chamber 24. For example, barrier 26 may have one or more openings that define an inlet 30 that is provided at the first end for interfacing the exterior and one ore more openings that define an outlet 32 provided at the second end for interfacing chamber 24.

Channel 28 may be substantially filled with a porous material, a polymer, metal, plastic, etc., for example, or a type of solid material that may be provided with holes or is otherwise rendered gas permeable or semi-permeable. In one implementation, channel 28 may include a type of foam material or a type of cellular structure, for example, that exhibits absorptive properties. In another implementation, channel 28 may include any combination of materials. The filler material may have airflow filtering and/or wind noise reduction properties.

Channel 28 may extend from about the first to about the second end within barrier 26, or any portion thereof, and may be substantially parallel or coplanar with the inner and outer surfaces of barrier 36. Channel 28 may include walls 34, for example, which may be substantially airtight or gas impermeable. In one implementation, one or more of walls 34 may be rigid or semi-rigid. In another implementation, one or more of walls 34 may be flexible. Walls 34 may include a combination of one or more of these types. In the first embodiment, walls 34 may face and/or co-extend with chamber 24 and the exterior to channel 28, e.g., walls 34 may define channel 28. Channel 28 may define an airflow route or path, for example, which includes at least one air deflector or redirection unit, for instance, to produce a bend or "turn" that results in a change in course and is shown as having two turns.

Microphone 22 (e.g., directional or omni-directional), may be disposed so as to face or be directed substantially toward barrier 26. At least a portion of microphone 22 may project into chamber 24. Barrier 26 may be directed in a direction from where speech of the user may be picked up when the user wears headset 10.

Figure 3:
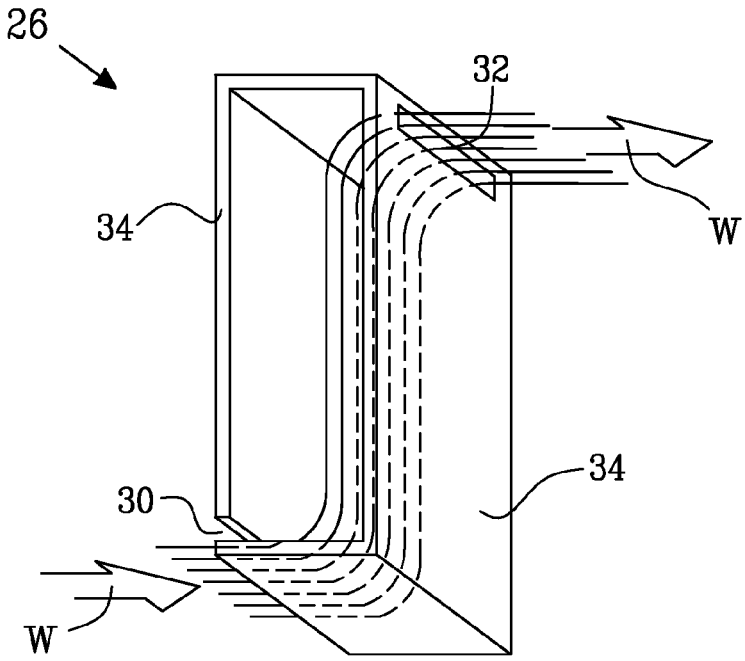
FIG. 3 schematically shows a perspective view of a barrier in microphone unit according to the first embodiment.

FIG. 3 schematically shows a perspective view of barrier 26 for microphone unit 20 according to the first embodiment. As can be seen, airflow represented as a wind W may enter barrier 26 at a first end and exit barrier 26 at a second end.

The first embodiment of microphone unit 20 may provide a number of advantages. For example, in operation, sound may be readily picked up from the mouth of the user, while at the same time the wind noise may be substantially reduced. It should be realized that a number of features of the first embodiment influence the associated reduction of detected wind noise. For example, sound waves and/or incidental airflow may be transported a relative extended distance inside barrier 26, i.e., the channel structure causes the sound to travel a considerable distance in the filler material. In addition, the airflow direction of air introduced into channel is altered. Each change in the course of the flow path results in less ultimate wind noise experienced at microphone 22. That is, the effective length of the flow path is directly related to the cumulative air resistance experienced in the airflow path and the resultant reduction in ultimate wind noise. The placement of microphone 22 so that it is not provided directly facing outlet 32, further provides a reduction in ultimate wind noise. Microphone unit 20, according to the implementations of the present invention, is smaller (e.g., more compact) than existing microphone units that offer comparable wind noise reduction.

Figure 4:
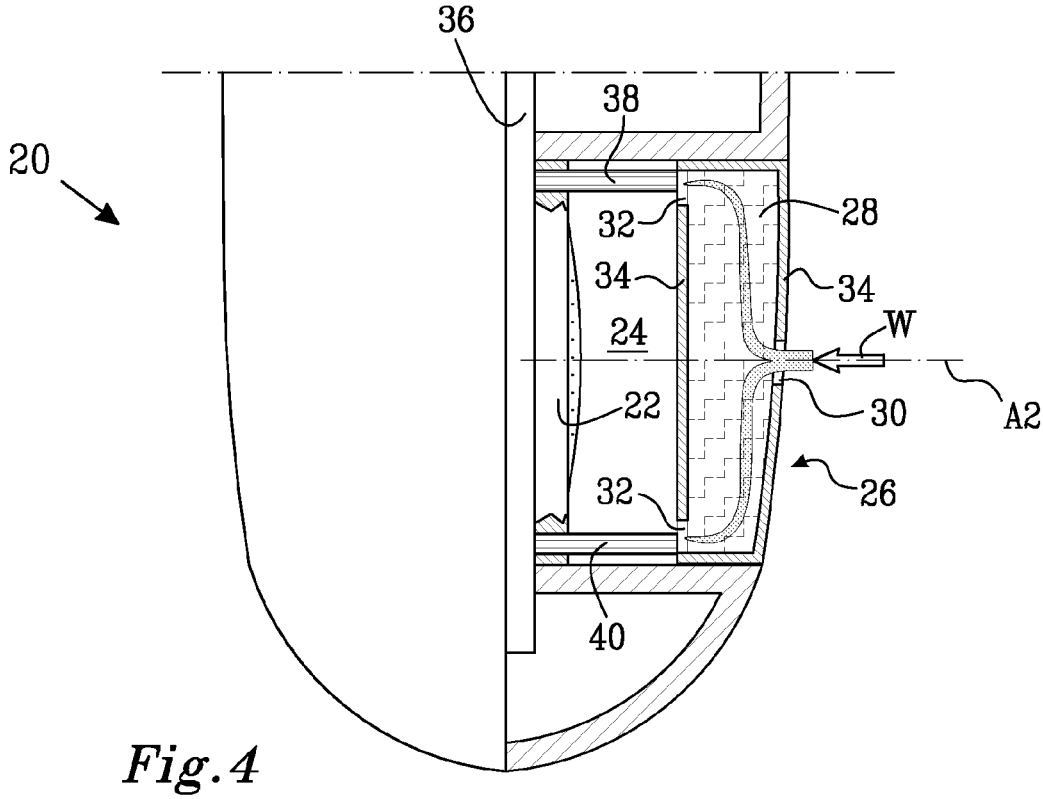
FIG. 4 shows a side view of a microphone unit provided in the headset of FIG. 1 according to a second embodiment of the present invention.

In FIG. 4, a side view of microphone unit 20 is shown that is exemplary of a second embodiment according to the present invention. Microphone unit 20 may include an omni-directional and/or a directional microphone. Chamber 24 and microphone 22 may be provided in substantially the same configuration as in the first embodiment, however, with a number of variations.

For example, a rotational-symmetry axis A2 associated with chamber 24 is shown as bisecting a middle of chamber 24, in a direction from the bottom side (here PCB 36) toward barrier 26. Axis A2 may be substantially perpendicular to the bottom side and may transverse barrier 26 in the middle between the first and second ends. Barrier 26 may have a configuration that differs from that of the first embodiment. For example, inlet 30 may at least partially coincide or be coaxial with axis A2, while outlet 32 may be distanced or off-center from axis A2 and, for example, provided symmetrically around axis A2. This is indicated in FIG. 4 as outlet 32 being provided at either end of barrier 26, shown as equidistant from inlet 32, but may vary in distance from inlet 30 (and Axis A2).

Figure 5:
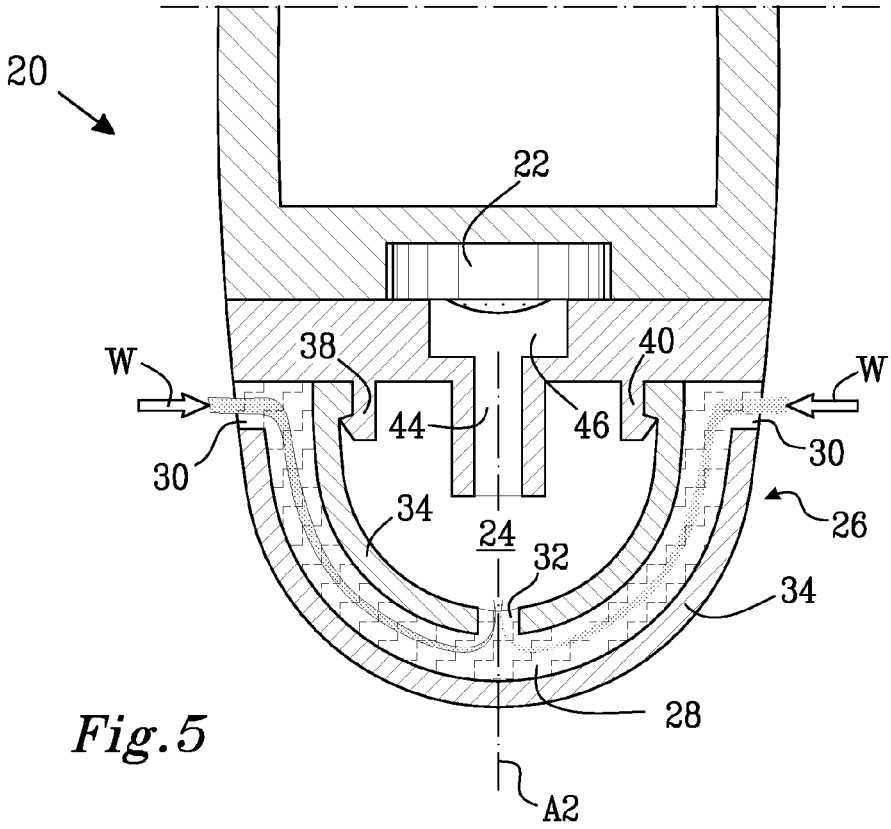
FIG. 5 shows a side view of a microphone unit provided in the headset of FIG. 1 according to a third embodiment of the present invention.

In FIG. 5, a side view of microphone unit 20 is shown as an exemplary third embodiment according to the present invention. Microphone unit 20 may include an omni-directional and/or a directional microphone. Chamber 24 may be provided at the rounded end of second arm 16. Chamber 24 may have a bottom surface that may be provided, for example, through the casing of second arm 16.

Barrier 26 may be defined by all of the walls of chamber 24, which meet at the top provided at the rounded end of second arm 16. That is, the bottom surface and barrier 26 may define and enclose chamber 24. For example, barrier 26 may have a substantially hemispherical shape. Other regular or irregular shapes are possible. A rotational-symmetry axis A2 is shown as bisecting a middle of chamber 24, in a direction from the bottom side toward barrier 26. Axis A2 me be substantially perpendicular to the bottom side and may traverse barrier 26 in the middle, i.e., at the top of a hemisphere.

Channel 28 in barrier 26 may be provided substantially symmetrically around axis A2 and inlet 30 may be provided substantially around the bottom surface of chamber 24, which form the first end. Inlet 30 may thus be distanced from and provided substantially symmetrically around axis A2. Outlet 32 may be provided at a second end of barrier 26, which is shown as being at the top of the hemisphere. As is shown in FIG. 5, outlet 30 may face chamber 24 and may be substantially aligned or coaxial with axis A2.

Channel 28 may be filled substantially as previously described with a porous, wind-reducing material and may include walls that are substantially airtight. Channel 28 may be provided along the inner and outer surfaces of barrier 26. Outlet 32 may be provided at the central top of the rounded end, while inlet 30 may be provided close to the bottom surface of chamber 24, so that sound waves and/or incidental air may travel a relatively extended distance inside channel 28 within the porous material. In the third embodiment, microphone 22 may be provided in a separate microphone chamber 46 that may connect with chamber 24 via, for example, a sound channel 44.

Figure 6:
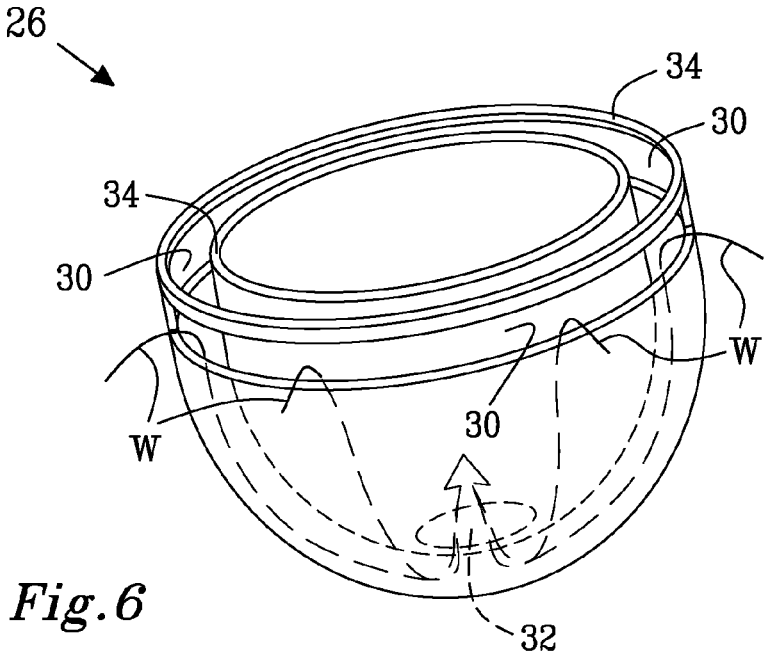
FIG. 6 schematically shows a perspective view of a barrier in microphone unit according to the third embodiment.

FIG. 6 schematically shows a perspective view of barrier 26 in microphone unit 20 according to the third embodiment. As can be seen, wind W can enter barrier 26 at the first end and exit barrier 26 at the second end.

The third embodiment may provide similar advantages to those of the second embodiment. Furthermore, by providing microphone 22 so as to communicate with the chamber 24 via sound channel 44 further influences of the wind noise in microphone operation are reduced. Other advantages with providing microphone in separate microphone chamber 46 include that it is easier to achieve the proper seals due to less integration. It is also possible to have an increased effective air volume within given outer dimensions. Yet another advantage includes greater freedom in designing placement of microphone 22 to acoustically enter the air volume provided by separate microphone chamber 46.

It should be realized that microphone unit 20 according to the second embodiment may be provided with an inlet and outlet as described with respect to the third embodiment. Furthermore, microphone unit 20 of the third embodiment may be provided with an inlet and/or an outlet similar to that described with respect to the second embodiment.

Figure 7:
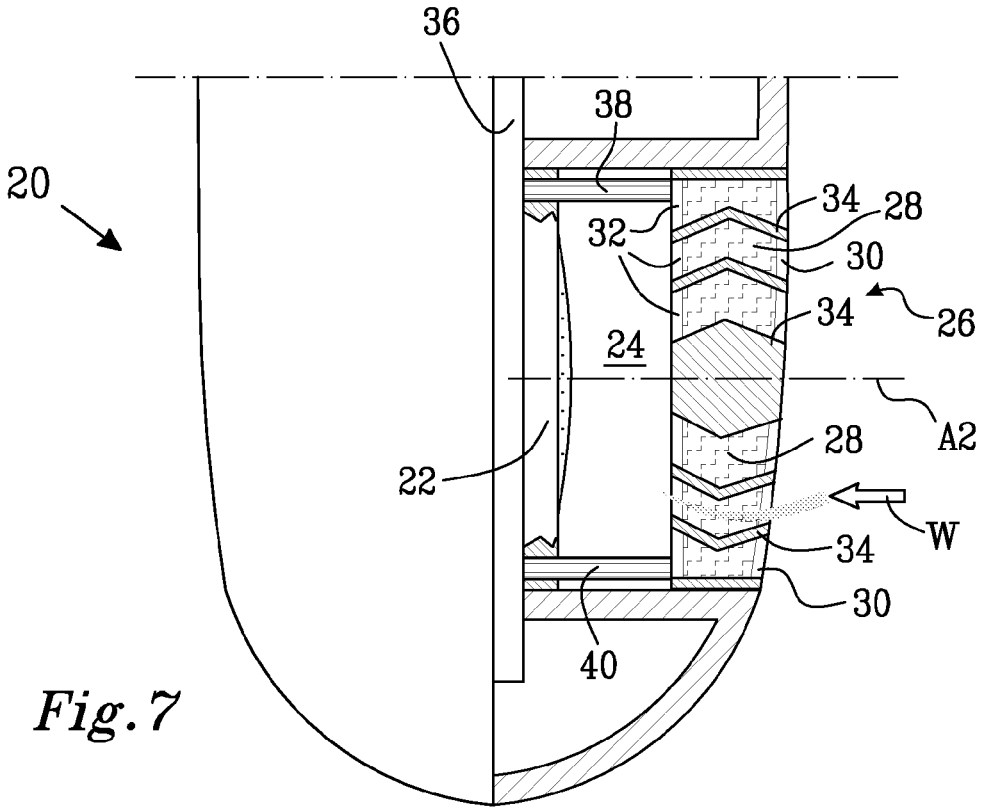
FIG. 7 shows a side view of a microphone unit provided in the headset of FIG. 1 according to a fourth embodiment of the present invention.

FIG. 7 shows an exemplary fourth embodiment of microphone unit 20 according to the present invention, in which microphone 22 may be provided in chamber 24 behind barrier 26 with symmetry axis A2 similar to that described with respect to the second embodiment shown in FIG. 4, where microphone 22 may include an omni-directional and/or directional microphone.

As shown in FIG. 7, the fourth embodiment may deviate in a number of ways from the exemplary arrangement shown in FIG. 4. For example, barrier 26 may be internally configured differently. Barrier 26 may be provided with one or more channels 28 traversing through barrier 26, for example, being defined by substantially airtight walls, and including porous wind reduction material and/or at least one turn or deflect. The number of curves or turns may vary, but for purposes of discussion, only one turn is shown. Inlets 30 associated with channels 28 may be provided at the outer surface of barrier 26 and substantially aligned with corresponding outlets 32 provided at the inner surface of barrier 26. Channels 28, for example, may be provided concentrically to axis A2. Other configurations of channels 28 vis-à-vis axis A2 and/or each other are possible.

The leading portion of channels 28 (e.g., before a first turn) that serves as an ingress to connect with inlet 30 may be provided at a predetermined angle to axis A2 of from about zero to about ninety degrees. For example, five, ten, fifteen, twenty, twenty-five, thirty, thirty-five, forty, forty-five, fifty, fifty-five, sixty, sixty-five, seventy-five, eighty, eighty-five, or any angle in between. The trailing portion of channels 28 (e.g., after a final turn) that serves as an egress to connect with outlet 32 may be provided at a predetermined angle to axis A2 of from about zero to about ninety degrees. For example, five, ten, fifteen, twenty, twenty-five, thirty, thirty-five, forty, forty-five, fifty, fifty-five, sixty, sixty-five, seventy-five, eighty, eighty-five, or any angle in between. The angles may be equal or may vary among channels, for example, based on their location within microphone unit 20 relative to, for example, a position with respect to the user's mouth, etc.

A multi-channel configuration may provide a combined travel path via which sound and/or incidental air may travel in barrier 26 that is effectively longer than an actual distance. In this way, the air resistance may be increased and a substantial wind noise reduction may be obtained.

Figure 8:
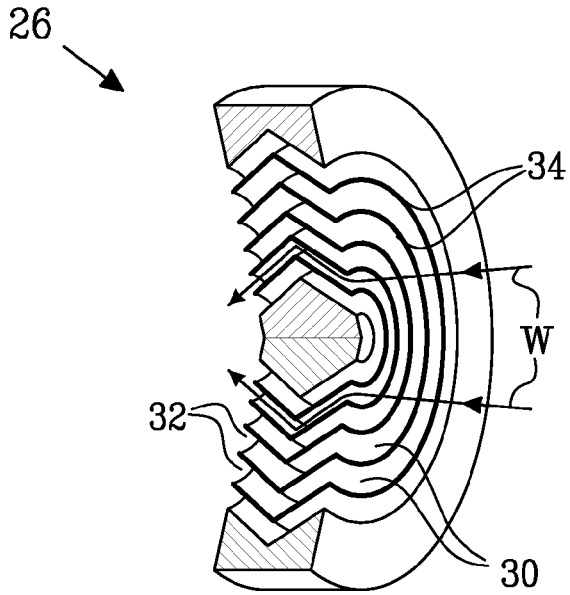
FIG. 8 schematically shows a perspective view of a barrier in microphone unit according to the fourth embodiment where a section has been cut-away.

FIG. 8 schematically shows a perspective view of barrier 26 in microphone unit 20 according to the fourth embodiment where a section has been cut-away. From FIG. 8, an exemplary symmetrical shape of channels 28 may be clearly visible. Other arrangements are possible.

Figure 9:
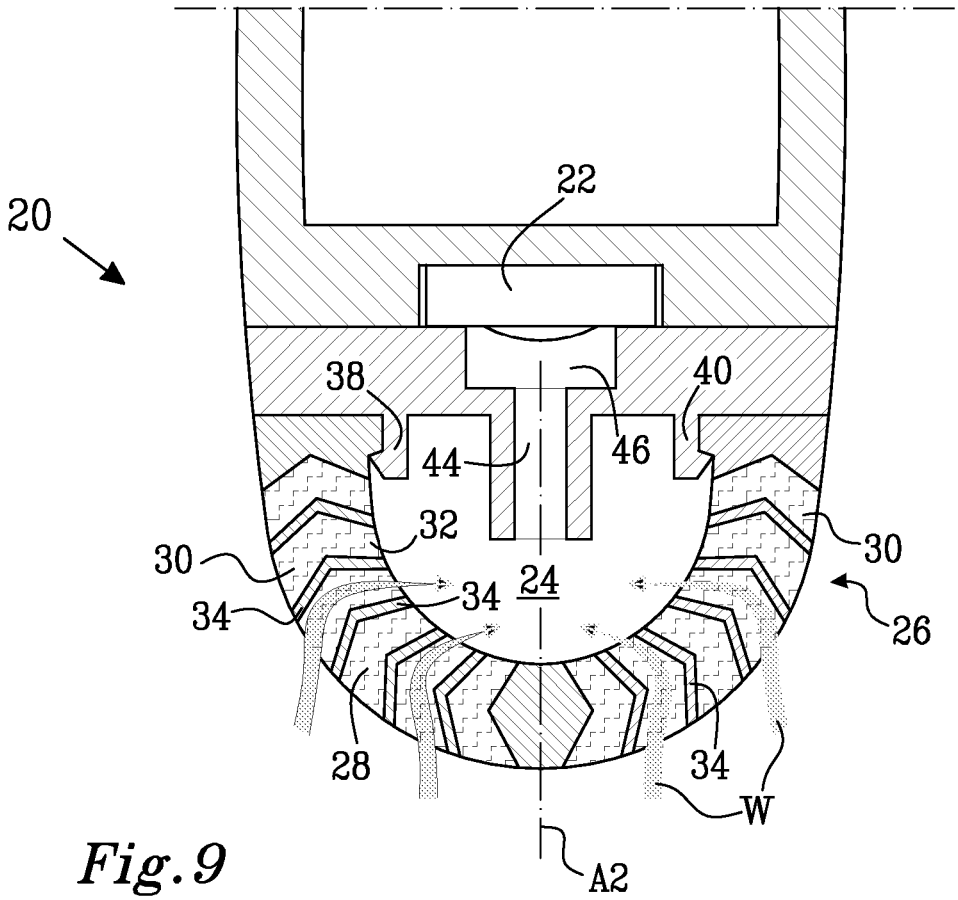
FIG. 9 shows a side view of a microphone unit provided in the headset of FIG. 1 according to a fifth embodiment of the present invention.

FIG. 9 shows an exemplary fifth embodiment of microphone unit 20 according to the present invention. Microphone 22 may connect to separate microphone chamber 46 via sound channel 44, as in FIG. 5. Chamber 24 and/or barrier 26 may have a similar general shape to that shown in FIG. 5, and chamber 24 may be bisected by rotational-symmetrical axis A2, as in FIG. 5. However, channels 28 traversing barrier 26 may provided similarly to those described with respect to FIG. 7, i.e., substantially symmetrically around axis A2.

Figure 10:
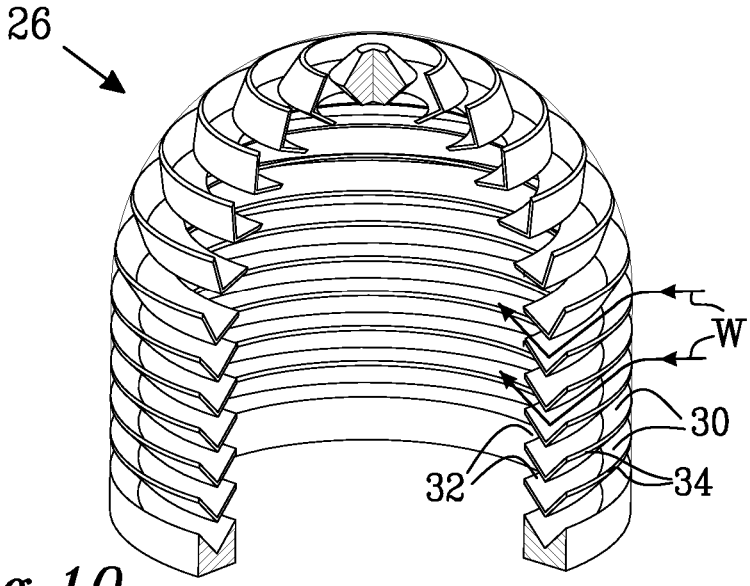
FIG. 10 schematically shows a perspective view of a barrier in microphone unit according to the fifth embodiment where a section has been cut-away.

FIG. 10 schematically shows a perspective view of barrier 26 in microphone unit 20 according to the fifth embodiment, as a cut-away view. From this figure, an exemplary symmetrical shape of channels 28 may be clearly visible. Other arrangements are possible.

Figure 11:
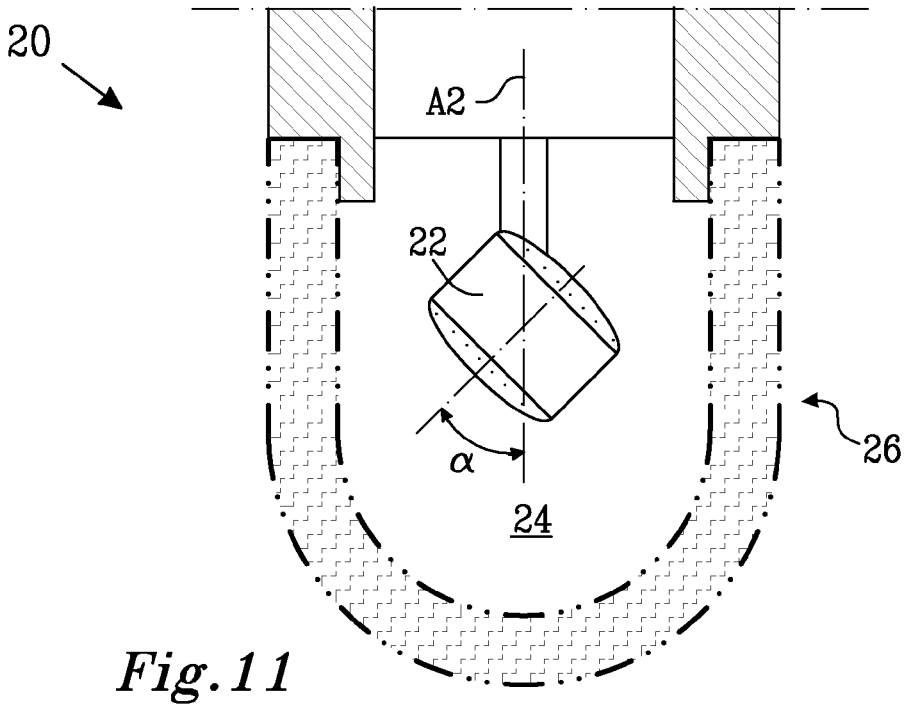
FIG. 11 shows a side view of a first alternative orientation of a microphone in the headset of FIG. 1.

FIG. 11 shows an exemplary variation of the present invention. As shown, microphone 22 may be directional and provided in chamber 24 similar to that of the first, second, and fourth embodiments. However, chamber 24 and/or barrier 26 may be shaped substantially similar to that of the third and fifth embodiments. Microphone 22 may be angled away from axis A2 so that a direction from which microphone 22 receives sound is angled relative to axis A2, for example, with an angle $\alpha$ that is, for example, about 45 degrees. Other angles are possible. Accordingly, microphone 22 may be directed toward the end where sound from a mouth of the user would be emitted. Channels traversing barrier 26 are not shown. The channels may be provided substantially similar to any of those previously described. The angle $\alpha$ may be selected differently. Angle $\alpha$ may be generally angled for being directed toward a direction where microphone 22 is suitable to pick up sound from the mouth of the user.

Figure 12:
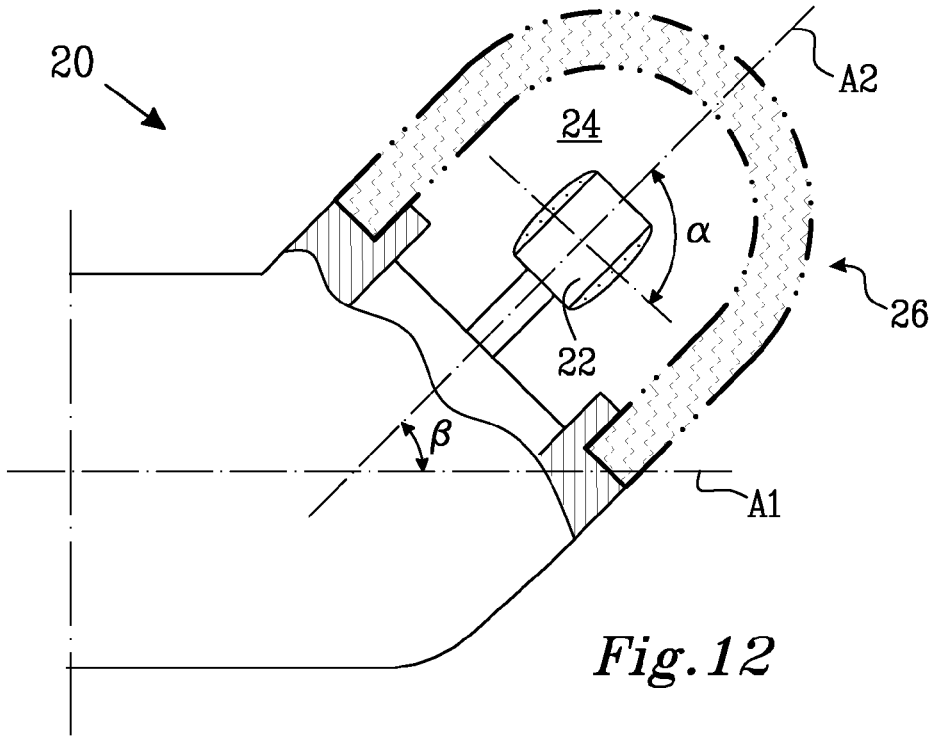
FIG. 12 shows a side view of a second alternative orientation of a microphone in an alternatively shaped headset.

FIG. 12 shows another exemplary variation of the present invention. For example, microphone 22, which may be directional and/or omni-directional, may be provided in chamber 24, substantially as in FIG. 11. Barrier 26 may be provided substantially similarly to any of those previously described.

However, a portion of or the entire microphone unit 20 may be angled away from longitudinal axis A1 of second arm 26 so that axis A2 may be angled away from longitudinal axis A1 with an angle β that may be, for example, about forty-five degrees. Other angles are possible. Microphone 22 may be, for example, angled in relation to axis A2 with an angle α that may be, for example, about ninety degrees. Other angles are possible. The direction of microphone 22 may have an angular relationship of about forty-five degrees to longitudinal axis A1 of second arm 16. Other angles are possible. Microphone 22 may be positioned so that it may be directed toward the end where sound from a mouth of the user would be emitted. Angles α and β may, in some implementations, be selected differently. Angle β may be, for example, selected for providing an ergonomical, functional, and/or aesthetical configuration of headset 10, and angle α may be selected for directing microphone 22 toward a direction that is suitable for picking up sound from the mouth of the user for selected angle β.

According to yet another exemplary variation of the present invention, an additional chamber may be provided that provides an air volume beneath the bottom surface of the air-filled chamber. The additional chamber may be in contact with chamber 24 via a passage, for example, in the form of one or more vents.

It should here be realized that the present invention may be varied in many more ways than that which has been described. For instance, second arm 16 may be omitted. That is, microphone unit 20 and earpiece 12 may be a unitary or integral unit. In practice, the present invention may be provided in other types of hands-free devices than that of headset 10. Implementations of the invention are not limited to hands-free devices at all, but rather may be provided in any accessory to a portable communication device, such as, for instance, cellular phones. The invention is not limited to accessories either, but rather may be provided in any portable device where sound is to be received and/or recorded. Thus, implementations may be provided in, for instance, a cellular phone or in a laptop, as well as any device having audio functionality.

It should be realized that the use of a sound channel between microphone and the air filled chamber can be provided by itself, i.e., without a barrier that has one or more of the previously described channels in it. The sound channel may also be combined with a microphone unit according to any of the first, second, and fourth embodiments of the invention.

Neither is the invention limited to symmetrical barriers or to symmetrical microphone units or hemispherical shapes or any other shape in particular. Therefore, although the invention has been described with reference to particular embodiments, it is to be understood by those skilled in the art that various changes and modifications can be made without departing from the spirit and scope of the invention.

What is claimed is:

1. A microphone unit for a portable sound receiving device, comprising:

a microphone;

a gas compartment, wherein the microphone is at least partially disposed in the gas compartment; and a barrier to at least partially cover the gas compartment, wherein the barrier includes at least one air passage channel to define a flow path from an exterior of the barrier to the gas compartment, the at least one air passage channel including at least one inlet at an outer surface of the barrier and at least one outlet to the gas compartment and at least one change of direction being provided in the flow path therebetween, wherein the at least one air passage channel contains a gas permeable material.

2. The microphone unit of claim 1, wherein walls defining the at least one air passage channel comprises a gas impermeable material.

3. The microphone unit of claim 1, wherein the outer surface is adjacent an exterior of the microphone unit and an inner surface of the barrier is adjacent the gas compartment, the barrier to attach at at least one of a first end or a second end of the gas compartment.

4. The microphone unit of claim 3, wherein the at least one air passage channel extends in a first direction within the barrier from the inner surface to the outer surface.

5. The microphone unit of claim 3, wherein the at least one air passage channel comprises a single air passage channel.

6. The microphone unit of claim 5, wherein the inlet is disposed at a first end of the barrier and the outlet is disposed at a second end of the barrier.

7. The microphone unit of claim 5, wherein the gas compartment has a bottom surface and a rotational-symmetrical axis traversing the bottom surface and a center of the gas compartment that is perpendicular to the bottom surface, the air passage channel being configured substantially symmetrically around the rotational-symmetrical axis.

8. The microphone unit of claim 7, wherein the inlet is coaxial with the rotational-symmetrical axis and the outlet is distanced from and configured substantially symmetrically around the rotational-symmetrical axis.

9. The microphone unit of claim 7, wherein the inlet is distanced from and configured substantially symmetrically around the rotational-symmetrical axis and the outlet is substantially coaxial with the a rotational-symmetrical axis.

10. The microphone unit of claim 3, wherein the at least one air passage channel comprises a set of air passage channels.

11. The microphone unit of claim 10, wherein the inlet of two or more air passage channels are substantially aligned with a corresponding outlet.

12. The microphone unit of claim 10, wherein the gas compartment has a bottom surface and a rotational-symmetrical axis traversing the bottom surface and a center of the gas compartment that is perpendicular to the bottom surface and the set of air passage channels are configured substantially symmetrically around the rotational-symmetrical axis.

13. The microphone unit of claim 1, wherein microphone is disposed at a distance from the outlet.

14. The microphone unit of claim 13, wherein gas compartment has a bottom surface and an axis traverses the bottom surface and a center of the gas compartment that is perpendicular to the bottom surface and where barrier defines walls that enclose the gas compartment, and the microphone is disposed at an angle relative to the axis.

15. The microphone unit of claim 14, wherein the microphone is a directional type of microphone.

16. The microphone unit of claim 14, wherein the angle is from about thirty to about forty-five degrees.

17. The microphone unit of claim 14, wherein the angle is from about forty-five to about ninety degrees.

18. The microphone unit of claim 1, wherein the microphone is separated from the gas compartment via another channel.

19. The microphone unit of claim 2, wherein at least some of the walls comprise a non-straight wall.

20. A sound receiving device comprising a microphone unit including:

a microphone, an air chamber, and a windscreen to cover at least a portion of the air chamber, wherein the windscreen includes:

at least one air passage channel connecting an exterior of the microphone unit to the air chamber and having at least one inlet at the exterior and at least one outlet to the air filled chamber, wherein the at least one air passage channel includes at least one bend defined therein, wherein the at least one air passage channel contains a gas permeable material.

21. The sound receiving device of claim 20, wherein the portable sound receiving device comprises a portable communication device.

22. The sound receiving device of claim 21, wherein the portable communication device comprises an accessory to another portable communication device.

23. The sound receiving device of claim 22, wherein the sound receiving device comprises a hands-free unit.

24. A microphone unit for a portable sound receiving device, comprising:

a microphone, an air filled chamber, a wind barrier to cover the air filled chamber, the wind barrier including at least one re-director unit, and a channel connecting the microphone with the air filled chamber, wherein the channel contains a gas permeable material.

25. A portable sound receiving device comprising:

a microphone unit including:

a microphone, an air filled chamber, and a wind barrier adjacent the air filled chamber for providing a wind shield, and a channel connecting the microphone with the air filled chamber, wherein the wind barrier includes at least one re-direction in an airflow defined an air passage channel defined therein, wherein the air passage channel contains a gas permeable material.

* * * * *